US005174574A

United States Patent [19]

Knox et al.

[11] Patent Number: 5,174,574

[45] Date of Patent: Dec. 29, 1992

[54] PUTTING TARGET

[75] Inventors: J. Paul Knox; Robert B. Murray, III, both of Springfield; Clinton L. Smith, Ozark, all of Mo.

[73] Assignee: Golf Vegas International, Inc., Ozark, Mo.

[21] Appl. No.: 796,604

[22] Filed: Nov. 21, 1991

Related U.S. Application Data

[62] Division of Ser. No. 636,893, Jan. 2, 1991, Pat. No. 5,067,718.

[51] Int. Cl.[5] ..... A63B 57/00; A63B 69/36

[52] U.S. Cl. ..... 273/179 B; 273/176 K; 273/127 C; 273/54 A

[58] Field of Search ..... 273/179 A, 179 R, 179 B, 273/179 C, 179 D, 179 E, 176 F, 176 FA, 182 R, 182 A, 127 R, 127 C, 180, 176 K, 54 A

[56] References Cited

U.S. PATENT DOCUMENTS 3,184,239 5/1965 Heuser ..... 273/176 FA 4,078,806 3/1978 Brandell ..... 273/179 A

*Primary Examiner*—George J. Marlo

*Attorney, Agent, or Firm*—Kokjer, Kircher, Bowman & Johnson

[57] ABSTRACT

A golf putting device includes a shell which presents a ball receiving chamber open at the front to receive incoming putted golf balls. A row of LED's across the front of the compartment may be selectively energized to vary the target area from cycle to cycle. An infrared transmitter on one side of the chamber emits energy which is received by two receivers located on the opposite side of the chamber. By sensing the time one beam is intercepted by the ball and using the known ball size, the ball speed can be calculated. By sensing the interval between the times the two beams are intercepted and using the ball speed, the position of the ball transversely can be calculated to determine whether it is on target or off target. An automatic ball return mechanism includes a paddle which sweeps the ball forward in the chamber and pivots to eject the ball back to the starting position.

3 Claims, 5 Drawing Sheets

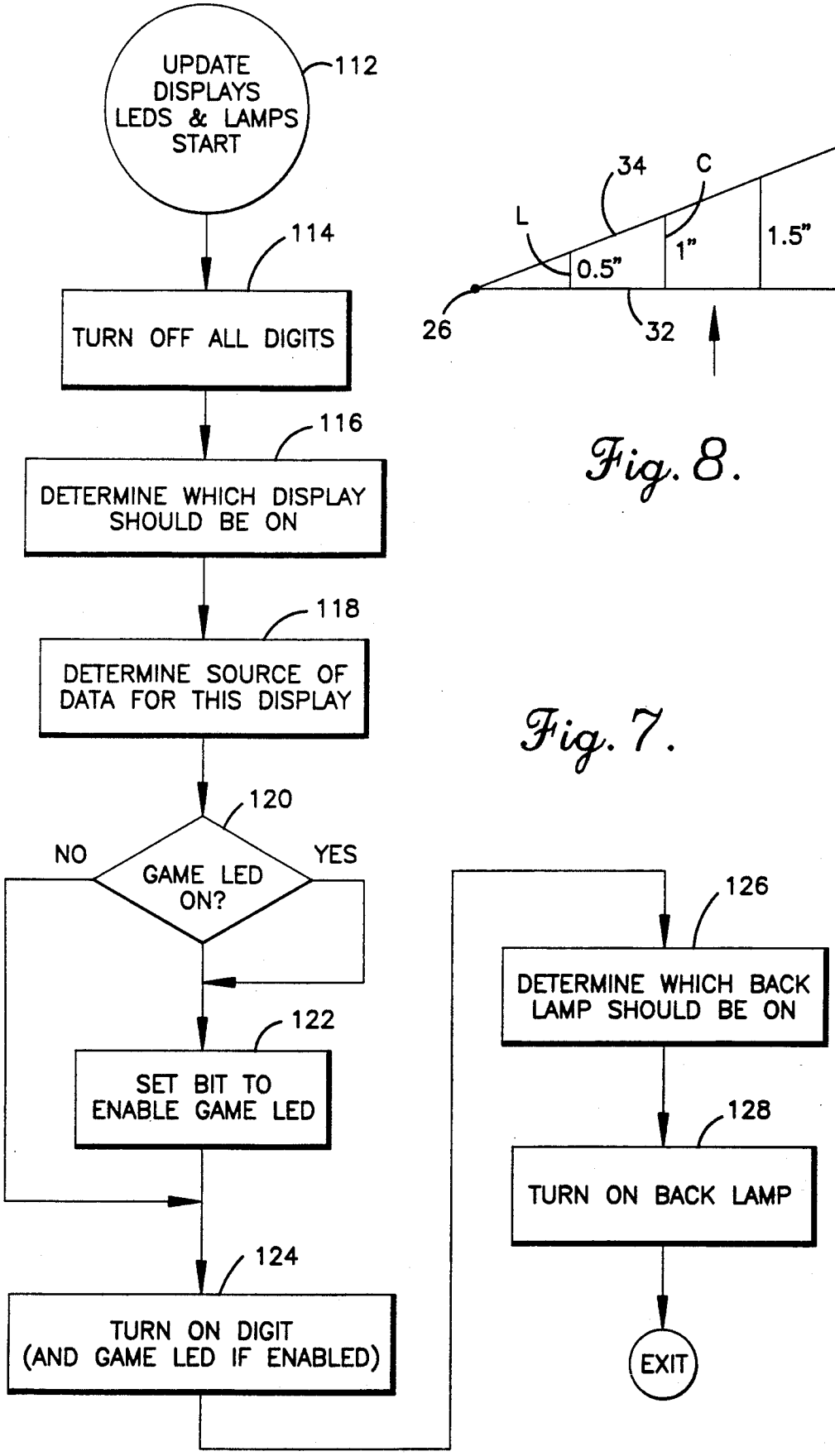
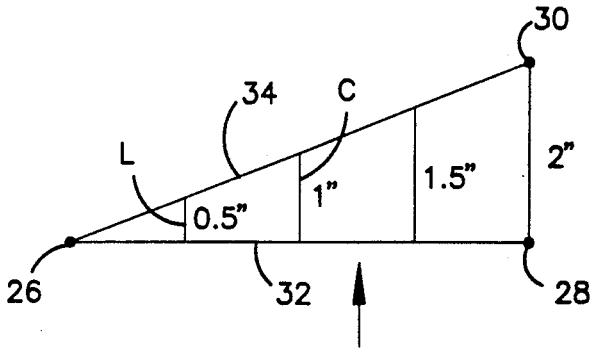
Fig. 8.
Fig. 7.

PUTTING TARGET

This is a division of application Ser. No. 636,893, filed Jan. 2, 1991, now U.S. Pat. No. 5,067,718.

BACKGROUND AND SUMMARY OF THE INVENTION

This invention relates generally to the putting of golf balls and more particularly to a method and apparatus for putting practice and/or amusement.

In the past, many putting practice devices have been available. One device includes a flat bottom cup which is placed on a rug or other putting surface and which is equipped with pivotal leaves that allow the ball to roll into the hole area of the cup but not out of it if the speed of the ball is correct. Other devices have included spring loaded or solenoid operated ball return mechanisms for propelling the ball back to the starting area. Virtually all prior devices have suffered from the inability to realistically simulate the conditions that are encountered during actual putting, and they are also unable to provide "feedback" that is valuable in enabling participants to improve their putting, both with respect to ball speed and direction.

The present invention is directed to a putting device that is useful both for amusement and for practice. In accordance with the invention, a chamber into which the ball may be putted has a row of light emitting diodes or other indicators across its open front end. The diodes may be energized in selected patterns to define the "hole" or target area at which the ball should be aimed. The target can thus be moved across the width of the housing so that it can be on the left or right sides or in the center area to provide variety.

Inside the chamber, an infrared transmitter on one side emits infrared energy toward two spaced apart receivers on the other side of the chamber. One receiver is directly across from the transmitter so that the infrared energy it receives is contained in a beam which is transverse to the ball path. The other receiver is spaced from the first receiver so that the energy it receives can be considered to be in a beam that is oriented at an acute angle to the transverse beam.

The provision of two beams arranged in this fashion allows both the ball speed and its position to be accurately determined. By sensing the time the first beam is broken by a ball rolling through it, the ball speed can be calculated using the ball diameter which is a standard 1.68 inches for golf balls. By sensing the time that elapses between the interception of the two beams, the transverse position of the ball can be calculated using the ball speed and the known distance between the beams at different transverse locations. Thus, the two meaningful parameters of ball direction and ball speed can be calculated and can be displayed to the participant on a display board. Other meaningful information can also be displayed, including average ball speed calculated over preceding putting cycles, the percentage of putts that are on target, the percentage that are left of target and the percentage that are right of target.

Although the device has no actual "hole" into which an on-target putt drops, the conditions under which actual putting takes place are realistically simulated. The display informs the participant whether the putt was on target or off target and on which side of the target it missed, and the ball speed is also given so that the participant can immediately see that its speed was about right or perhaps rather high such that the putt would roll well beyond the hole if off target. Adding to the realism are sound effects which include a realistic simulation of a golf ball dropping into a cup for on target putts and a "cat call" or "raspberry" sound for off target putts.

The invention is particularly characterized by a simple and effective ball return mechanism that avoids the problems associated with spring loaded or solenoid operated catapult type ball return systems. A carriage is reciprocated in the ball receiving chamber by an electric motor and a belt drive system. The carriage is equipped with a paddle which sweeps the ball forwardly and pivots in order to eject the ball through the open end of the chamber and back to the starting position. The paddle is tripped by a pair of pins which are engaged by projecting arms of the paddle when it reaches the open end of the chamber, and this causes the paddle to pivot such that it flips the ball back to the starting area.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:

FIG. 7 is a flow chart for the subroutine involving updating the displays, LED's and lamps; and FIG. 8 is a diagrammatic illustration of the two infrared beams which permit the ball speed and position to be determined in accordance with the invention.

DETAILED DESCRIPTION OF THE INVENTION

Figure 1:
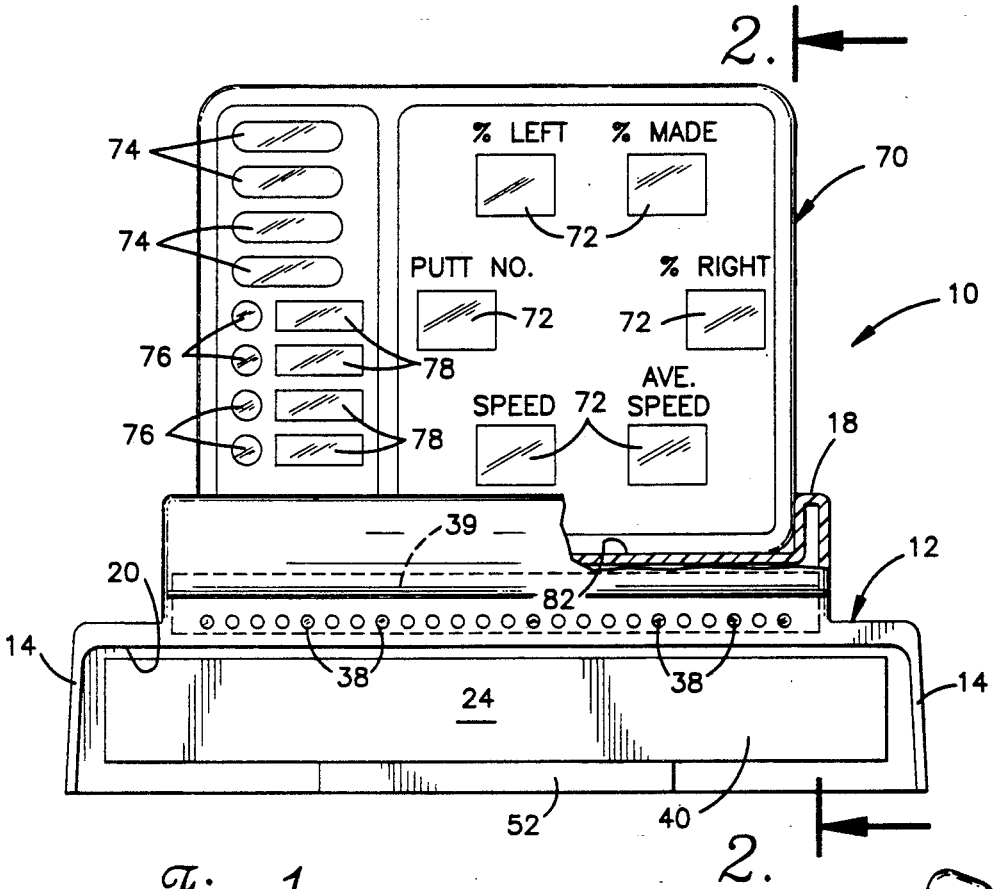
FIG. 1 is a front elevational view of a golf putting practice/game device constructed according to a preferred embodiment of the present invention, with a portion broken away for purposes of illustration.

Referring now to the drawings in more detail, numeral 10 generally designates a golf putting device which takes the form of an amusement game that also provides for putting practice in order to improve putting performance. The device 10 has as its main structural component a hollow shell 12 which may have a molded plastic construction or any other suitable construction. The shell 12 has opposite sides 14, a back wall 16 and a top 18. The front of the shell 12 is open to provide an opening 20 between the sides 14. The height of the opening 20 is greater than the standard 1.68 inch diameter of a golf ball 22 (see FIGS. 2 and 3). The shell 12 is hollow in order to present within it a ball receiving compartment 24 which the ball may enter and leave through the front opening 20. The shell 12 may be open at the bottom and rest on a suitable flat supporting surface such as the surface S, or the bottom of the shell may be provided with a floor (not shown) if desired. Preferably, the front of the unit is devoid of dividers that the ball could strike, although one or more dividers or partitions could be present.

The golf ball 22 is putted along a path which terminates at the shell 12 and which has a width dimension W (FIG. 4) substantially the same as the width of the opening 20 between the opposite sides 14 of the shell. The path along which the ball 22 is putted may take the form of a carpet or other suitable surface which may or may not be provided as part of the device 10. The putting path may have any suitable length. The longitudinal center line of the putting path is identified by the letter C in FIG. 4.

Figure 4:
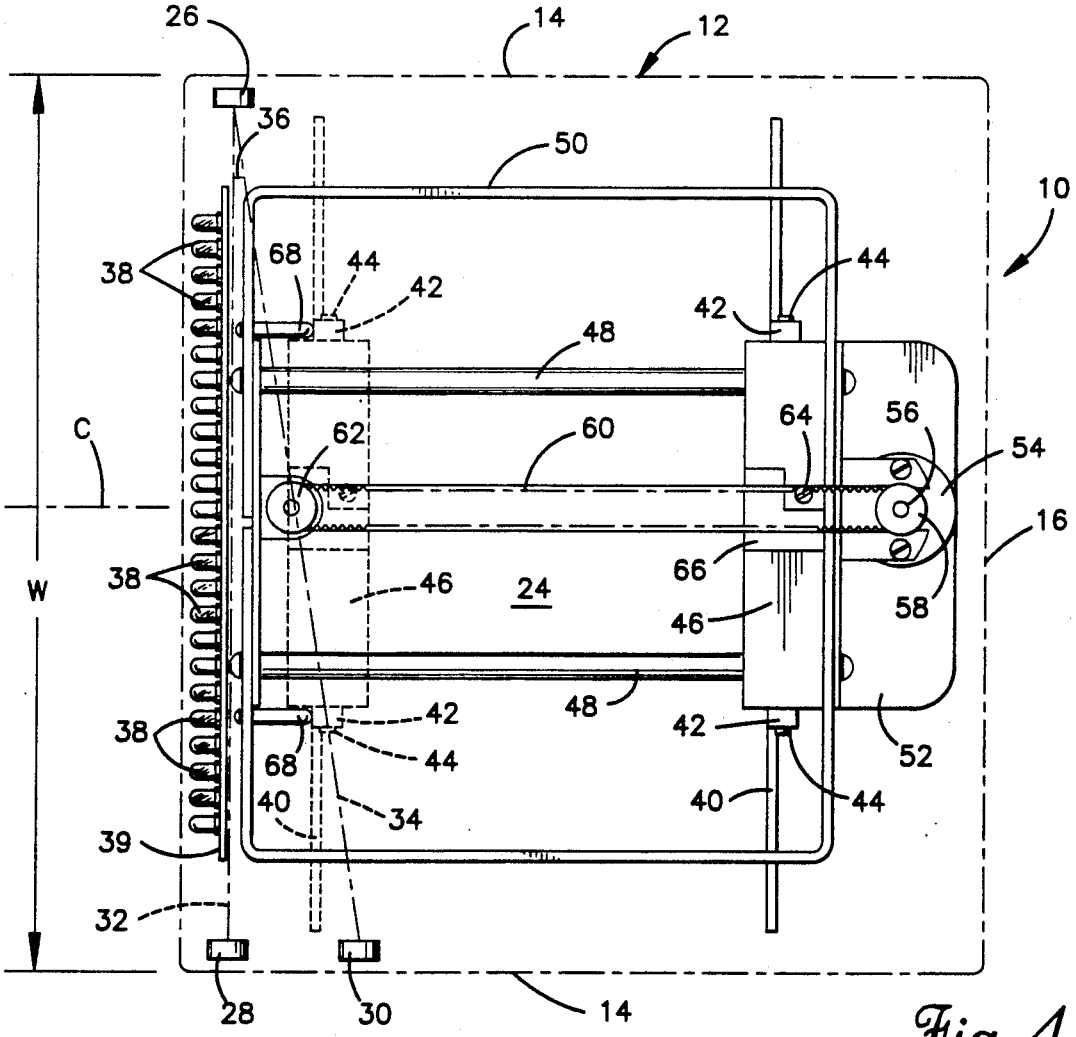
FIG. 4 is a fragmentary sectional view taken generally along line 4—4 of FIG. 2 in the direction of the arrows, with the outline of the shell of the device shown in dashed lines for simplicity.

Referring to FIG. 4 in particular, an infrared transmitter 26 is provided within the shell 12 at location adjacent to one of the sides 14 (the left side as viewed from the front). The transmitter 26 is located near the opening 20 and may be energized to transmit infrared energy in a direction generally toward the opposite or right side 14 of the shell 12. A pair of infrared receivers 28 and 30 are located within the shell 12 adjacent to the opposite or right side 14. Both receivers are located on the opposite side of the path from the transmitter 26, although the receivers 28 and 30 are spaced apart from one another in the direction of the longitudinal axis of the path. By way of example, the second receiver 30 may be spaced behind the first receiver 28 by a distance of two inches. It may be desirable in some situations to provide more than one transmitter.

The first receiver 28 is located directly across the transverse dimension of the path from the transmitter 26. Consequently, the infrared energy which is sensed by receiver 28 is only the energy contained in a beam 32 which is oriented transversely to or at a right angle to the center line C of the putting path. By reason of the displacement of the second receiver 30 rearwardly from the first receiver 28, the energy receiver by receiver 30 is contained in a beam 34 which is oriented at an acute angle 36 to the transverse beam 32. The transmitter 26 and the receivers 28 and 30 are preferably centered at a height coinciding with the golf ball radius. Consequently, the ball 22 intercepts the beams 32 and 34 in succession as it rolls into the chamber 24.

The "hole" or target at which the ball is to be putted during each putting cycle is defined by an array of light emitting diodes (LED's) 38 which are arranged in a straight row extending transversely to the putting path. The LED's are mounted on a light bar 39 which is situated within the shell 12 at location above the opening 20. The LED's are visible from the front of the unit. The LED's 38 are preferably spaced apart from one another a distance of approximately ½ inch, and eight adjacent LED's 38 may be energized for each putting cycle. The width of the target area defined by the energized LED's is then about 4 inches in order to approximate the standard diameter of the cup in the game of golf.

The present invention is characterized by a ball return mechanism which automatically ejects the ball 22 from the chamber 24 each time the ball is putted into the chamber. The ball return mechanism includes a paddle 40 having a flat front face and a pair of upwardly projecting arms 42. The arms 42 are pivotally pinned at 44 to the opposite sides of a block 46 which provides a reciprocating carriage for the ball return mechanism. The two pivot pins 44 are axially aligned and provide a horizontal axis about which the paddle 40 may pivot relative to block 46. The block 46 is mounted for reciprocating movement along a pair of guide rods 48 which are parallel to one another and to the center line C of the putting path. The block 46 is provided with a pair of cylindrical bores through which the guide rods 48 closely extend such that the block 46 is confined to movement along the path defined by the rods.

Referring to FIG. 4 in particular, the guide rods 48 are secured at their front and back ends to a rectangular frame 50 which is suitably mounted within the upper portion of the ball receiving chamber 24. An L-shaped bracket 52 is connected with the back of the frame 50 and is located near the back wall 16 of the shell. A reversible electric motor 54 is mounted on the bracket 52. The motor 54 drives an output shaft 56 carrying a pulley 58. A drive belt 60 is drawn around pulley 58 and around another pulley 62 which is mounted to the front portion of the frame 50. The pulleys 58 and 62 define a path for the belt 60 which carries it parallel to the center line C of the putting path. The frame 50 may be eliminated and its function may be performed by some other means, including part of the shell.

The belt 60 is secured to block 46 by a screw 64 or in any other suitable manner. The opposite run of the belt extends through a slot 66 formed in the top of the block 46. The motor 54 may be energized in opposite directional modes in order to drive the block 46 in reciprocating motion between the fully retracted position shown in FIG. 2 and the fully extended position shown in solid lines in FIG. 3. In the fully retracted position, the paddle 40 is located at the rear of the ball receiving chamber 24. In a fully extended position, the paddle 40 is located adjacent to the opening 20. The paddle 40 is oriented transversely to the putting path and extends across substantially the entire width of the chamber 24. Consequently, when the paddle 40 is moved from the fully retracted position to the fully extended position, it conveys the ball along surfaces from the rear portion of the chamber 24 to the front portion of the chamber adjacent to the opening 20.

A pair of pins 68 are mounted on the front portion of the frame 50 and project rearwardly therefrom at location adjacent to the opening 20. The pins 68 are located at a height to engage the projecting arms 42 of paddle 40 when the paddle is in the fully extended position. Because the arms 42 project above the horizontal pivot axis defined by the axially aligned pins 44, engagement of the pins 68 against the arms 42 causes the paddle 40 to pivot upwardly and forwardly about the pins 44. As the paddle 40 continues forwardly after initial contact between the pins 68 and arms 42, the paddle is pivoted to the position shown in solid lines in FIG. 3, and it thus acts to eject the ball 22 through the opening 20 in a reverse direction along the putting path in order to return the ball t the starting position for another putting cycle. The pins can be mounted and oriented differently and still perform their function, and it is possible to use only a single pin or some other structure to perform the same function.

The device 10 is equipped with a display panel which is generally identified by numeral 70 and which has a front display face arranged to display information during playing of the game. For example, the face of the panel 70 may include a plurality of two digit alphanumeric display windows 72 each having a pair of seven bar displays. One of the display windows 72 may display the putt number (for example putt number 2 of a 10-putt cycle), another window may display the percentage of the putts that have been made during each cycle, another window may display the percentage of putts that are to the left of the target, another window may display the percentage of putts that are to the right of the target another of the windows 72 may display the speed of the immediately preceding putt, and the final window 72 may display the average speed of all putts during the cycle. Each of the windows 72 may display more than one piece of information, including a running score for each player.

On the left portion of the face of the display panel 70, additional information may be displayed. For example, the device may have the capability of allowing participants to select among various different types of games, and the particular game that has been selected may be displayed in one of the display windows 74. Below the windows 74, the circles 76 may indicate the player numbers, and the windows 78 across from the player number circles may digitally display the current score of the corresponding player.

It should be understood that alternative types of display information may be provided, and the arrangement of the display panel can be varied if desired. The display information may be displayed on a video screen which may be either built into the unit or separate.

Figure 2:
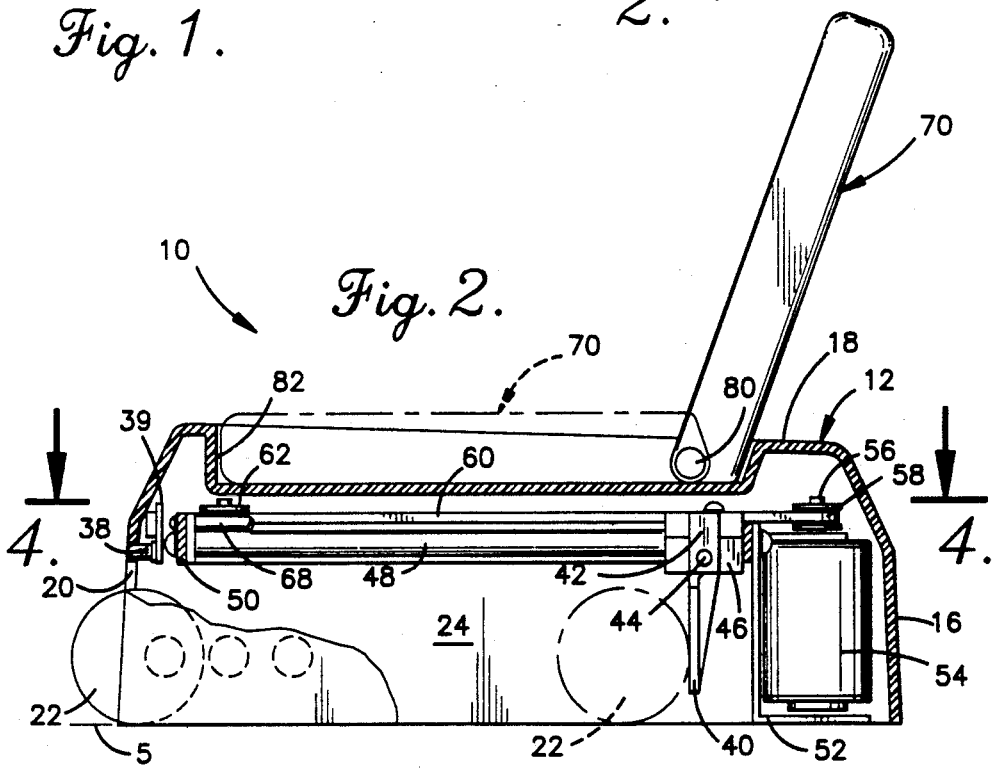
FIG. 2 is a sectional view taken generally along line 2—2 of FIG. 1 in the direction of the arrows, with the broken lines illustrating the storage position of the display panel of the device.
Figure 3:
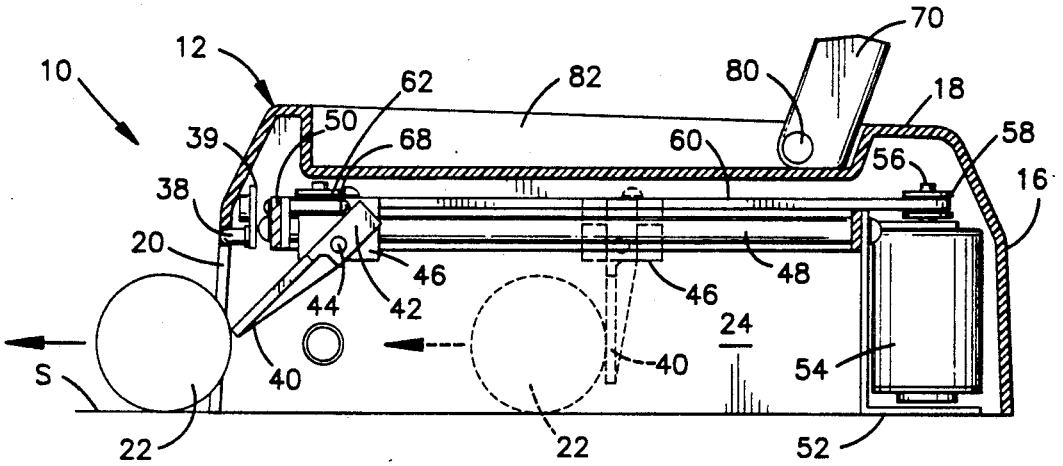
FIG. 3 is a fragmentary sectional view similar to FIG. 2, but with the solid lines showing the ball return mechanism in its fully extended position and the broken lines showing the ball return mechanism in a partially extended position.

As best shown in FIG. 2, the storage panel 70 is mounted to the top portion of the shell 12 for pivotal movement about the horizontal axis provided by the pivot pins 80. The top of the shell 12 is provided with a rectangular recess 82 within which the lower edge of the display panel 70 is pivoted. When the game is not in use, the display panel 70 can be folded about the pivot axis 80 to a storage position in which the panel fits in the recess 82. When the game is being used, the display panel is pivoted upwardly into the position shown in solid lines in FIG. 2 where the display face is readily visible from the front of the unit.

Figure 5:
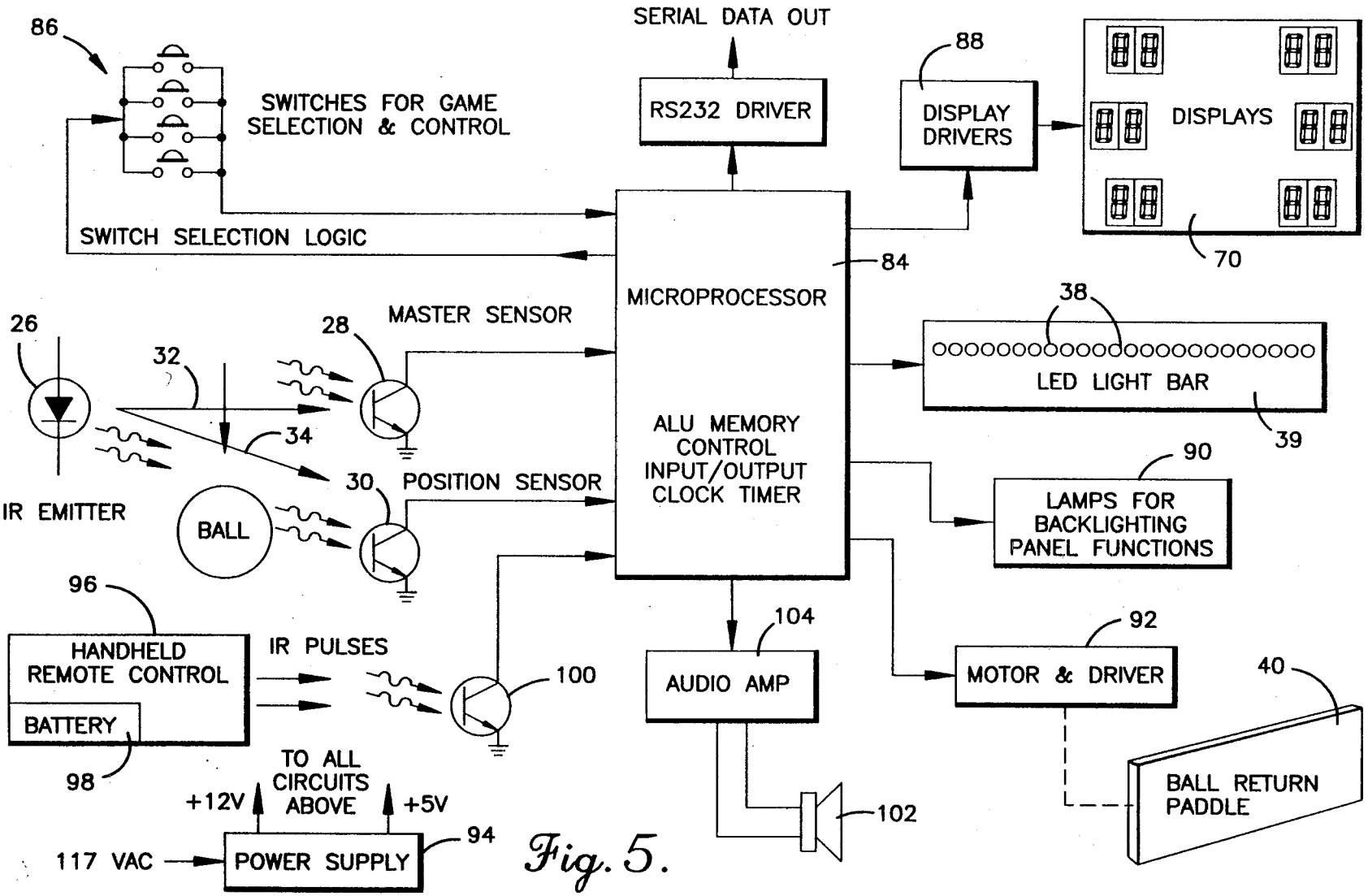
FIG. 5 is a block diagram of the electronic control system of the device.

FIG. 5 depicts in block diagram form the control system for the device 10. The main control component is a microprocessor 84 which receives input signals from the infrared receivers 28 and 30. A bank of switches 86 provides for the selection of different games and different numbers of players. The display panel 70 is controlled by the microprocessor through suitable display drivers 88. The microprocessor also controls through block 90 the lamps for backlighting the functions of the display panel 70. Control of the on/off and directional mode of the motor 54 is effected by the microprocessor through block 92.

A suitable power supply 94 provides power for driving the circuitry. A hand held remote control unit 96 may be provided and powered by its own battery 98. The remote control unit transmits infrared pulses which are sensed by a receiver 100 which provides suitable input signals to the microprocessor 84 dependency upon the frequency or other characteristics of the pulses. A speaker 102 is controlled by the microprocessor through an audio amplifier 104 in order to provide sound effects, as will be explained more fully.

Figure 6:
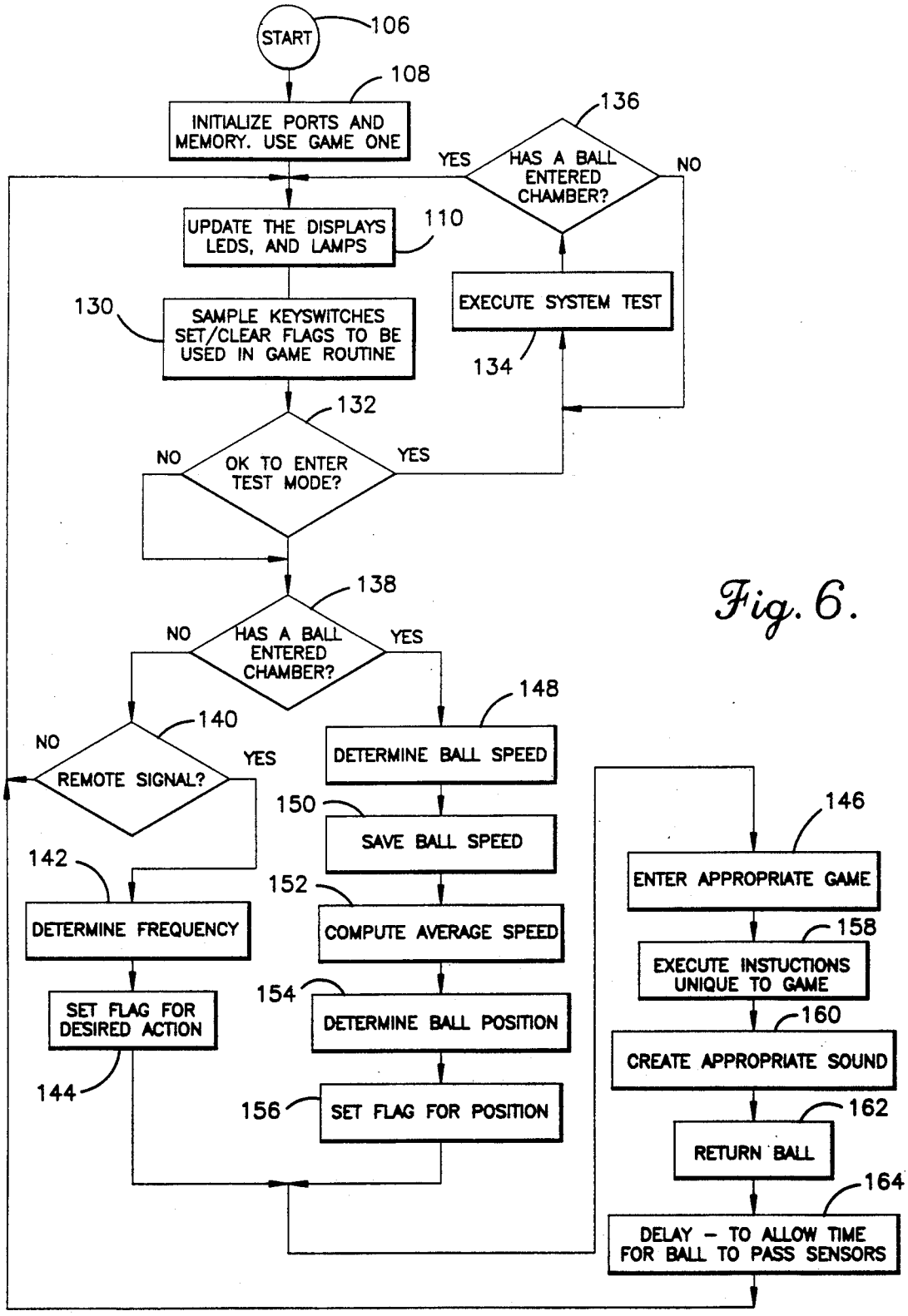
FIG. 6 is a flow chart depicting the sequence of operation of the device.

FIG. 6 illustrates a flow chart for the software of the device 10. From a start block 106, the ports and memory are initialized in block 108, and block 110 is then entered to update the various displays, LED's and lamps.

The subroutine which is carried out in block 110 is depicted in FIG. 7. From a start block 112, all digits are turned off in block 114. Block 116 is then entered to determine which display is to be on. In block 118, the source of the data for the particular display is determined. Block 120 is then entered and if the game LED is energized, block 122 is entered and the proper bit is set to enable the game LED. Block 124 is then entered from block 122 or, if the game LED is not on (as determined in block 120), block 124 is entered directly from block 120. From block 124, block 126 is entered to determine which backlamp is to be on, and the proper backlamp is then energized in block 128 prior to exit from the subroutine.

Referring again to FIG. 6, block 130 is entered at the end of the subroutine which is carried out in block 110. In block 130, the key switches are sampled and the flags (LED's) which are to be used in the particular game routine are set or cleared. Block 132 is then entered. If a test mode is to be entered, a system test is executed in block 134 and block 136 is then entered. Following the end of the test and after a ball has entered the chamber 24, the main loop is entered again and block 132 is eventually reached again.

If testing is not to take place or has been completed, block 138 is entered to determine whether or not a ball has entered the chamber 24. If it has not, block 140 is entered to determine whether a signal is received from the hand held remote control unit 96. If not, the main routine is entered again in block 110. If a remote signal is detected, the frequency of the signal is determined in block 142 and the flag is set in block 144 for the desired action that is indicated by the frequency that is received. Block 146 is then entered.

If it is determined in block 138 that a golf ball has entered the ball receiving chamber, block 148 is immediately entered and the ball speed is determined in a manner that will be explained more fully. The ball speed is saved in block 150 and the average speed over the selected number of preceding cycles is computed in block 152. The ball position is then determined in block 154, and the flag applicable to the ball position is set in block 156 prior to entering block 146.

In block 146, the appropriate game that is being played is determined. Next, block 158 is entered and the instructions that are unique to the game are executed. Block 160 effects the appropriate sound from the speaker 102. The motor 54 is then activated in the proper directional mode in block 162 to return the ball to the starting position. Finally, block 164 provides a time delay that allows the ball to pass through the beams 32 and 34 without being detected as an incoming ball.

In use, the golf ball 22 initially assumes a starting position spaced the desired distance in front of the shell 12 and along the putting path which terminates at the shell. After the appropriate game and number of players have been selected through the switches 86 and the six contiguous LED's 38 which define the target have been energized, the first player putts the ball toward the ball receiving chamber 24. As the ball passes through the first beam 32, it intercepts the beam for a time period that is dependent upon its speed. The time that the ball intercepts the beam 32 is sensed, and a calculation of the speed is made using the known ball diameter of 1.68 inches. By way of example, if the first beam 32 is intercepted for a period of 17.5 milliseconds, it is a simple calculation to divide this into the ball diameter of 1.68 inches to compute a ball speed of 96 inches per second or 8 feet per second.

After intercepting the first beam 32, the ball 22 subsequently intercepts the second beam 34. The time interval between the initial interception of beam 32 and the initial interception of beam 34 is sensed, and a calculation of the distance the ball traveled between the times it intercepted the two beams can be made by multiplying the ball speed times the time interval between the breaking of the two beams. For example, if a time period of 5 milliseconds elapses from the time beam 32 is intercepted until the time the second beam 34 is intercepted, the known ball speed of 96 inches per second can be multiplied by 5 milliseconds to compute that the ball traveled 0.48 inch during this time interval.

With reference to FIG. 8, it is pointed out that if the distance between the two receivers 28 and 30 is two inches, the distance between the beams is proximately 0.48 inch at a transverse location L which is about midway between the center of opening 24 and its left side. Consequently, the location L of the ball is indicated, and the appropriate LED's 38 are energized to indicate the position at which the ball entered opening 20.

In actual practice, the transverse dimension of the ball putting path may be broken up into 24 different segments each corresponding to one of the LED's 38. A "look up table" can be entered into the microprocessor 84 so that based on the ball speed that is calculated and the distance that is calculated between the times the two beams are intercepted, the look up table can be entered to find the closest match to the actual distance that is calculated. Then, the corresponding LED 38 is energized.

If a particular game involves 10 putting strokes, for example, a different target area may be provided for each . stroke. Eight adjacent LED's 38 are energized prior to each stroke in order to provide a "hole" that is approximately four inches wide to correspond generally with the actual diameter of a standard golf cup. The LED's that are energized may be on the extreme left, the center, the extreme right or anywhere in between so that the target area varies from cycle to cycle either randomly or in a programmed fashion. If the putt is on target, the LED that is energized will be within the eight energized LED's at the time, and this is considered to be a putt that is made. However, if the ball speed is greater than a predetermined value (such as 8 feet per second), it should be considered too fast and the putting cycle is considered to be a nullity regardless of the on target or off target direction of the ball.

The percentage of the putts that are to the left of the target area are calculated and displayed, the percentage that are to the right of the target area are calculated and displayed, and the percentage that are made are calculated and displayed. The speed of the immediately preceding putt is displayed, and the average speed over the entire cycle is calculated and displayed in one of the display windows 72. This information is valuable to participants because it tells them if their ball speed is proper and also whether there is a tendency to miss on the left or the right side of the target area. A running numerical score for each participant may be kept. For example, the rules of one game may assign a score of three to each putt that is on target, a score of two to each putt that is off target but close, a score of one to each putt that is well to one side of the target, and a score of zero to each putt that exceeds the maximum allowable speed.

Each time a putt enters the ball receiving chamber 24, a suitable sound effect is generated by the speaker 102. For example, for each putt that is on target and within the permitted speed range, the speaker 102 emits a sound that simulates a golf ball dropping into an actual cup. Conversely, for each putt that is off target and/or enters the compartment 24 at an unacceptably high speed, the speaker 102 can generate a "cat call" sound or a "raspberry" sound. These audio effects enhance the appeal of the game.

After the second beam 34 has been cleared by the ball during each putting cycle, the motor 54 is activated automatically in order to drive the paddle 40 to the extended position. If the ball has entered the chamber any more than about ¼ of the front to back dimension of the chamber, the paddle transfers enough momentum to return the ball without the need for flipping action. However, if the ball has barely entered the chamber, the paddle is still able to return the ball by making use of the flipping action of the paddle. When the projecting arms 42 are engaged by the pins 68 at the extreme forward position of the paddle, the paddle 40 flips upwardly and thereby ejects the ball 22 in a reverse direction to return it to the starting position so that the participants can proceed with the next putting cycle. After the paddle has reached its fully extended position, the directional mode of the motor 54 is reversed in order to drive the belt 60 in the reverse direction and return the paddle 40 to its retracted position prior to the start of the next putting cycle. If the ball only rolls far enough to barely enter the chamber and not break the beams, a remote control unit can be used to operate the paddle in order to return the ball to the starting position.

It is thus apparent that the game 10 provides both amusement and putting practice which is accompanied by valuable feedback information on the display board 70. The feedback information is valuable in that it informs the participants of both the speed and direction of their putts. It is contemplated that the device can be provided in various sizes, with a larger self-standing unit being available for installation in amusement arcades and other commercial settings. In this application, the unit is preferably equipped with a suitable carpet or other surface which extends into the ball receiving chamber 24 and which simulates an actual golf course putting green.

It is noted that the foregoing manner in which ball speed and position are calculated makes use of the ball velocity at the time it passe through the first beam 32 and does not take into account the deceleration of the ball between the two beams 32 and 34. At times the error introduced by deceleration can be appreciable, and the accuracy can be improved in all cases by taking deceleration into account.

One way to approximate the effect of deceleration is to calculate the ball speed at the time it passe through each beam 32 and 34 and take an average of the two speeds to calculate a velocity which is corrected for the effect of deceleration. Thus, the velocity can be calculated as $(V_{32}+V_{34})/2$, where $V_{32}$ is the ball speed at beam 32 and $V_{34}$ is the ball speed at beam 34. It is also noted that the known angle of the second beam 34 can be taken into account in calculating the ball velocity at beam 34.

This treatment makes use of the measured velocities $V_{32}$ and $V_{34}$ which are in reality only average velocities during the time the ball is moving through the respective beams. An even more accurate way of correcting for deceleration can be used by also taking into account the deceleration that occurs as the ball is moving through each beam. The acceleration a can be calculated as $a=(V_{34}-V_{32})/t$, where $V_{34}$ and $V_{32}$ are the average ball velocities measured as the ball moves through the respective beams 34 and 32 and t is the time that is measured between the breaking of the two beams. The velocity of the ball at the time it initially encounters beam 32 is represented as $V_{32i}$ and can be calculated from the formula $V_{32i}=V_{32}-at_{32}/2$, where $t_{32}$ is the time beam 32 is broken by the ball. The distance S the . ball moves between the beams is given by $S=V_{32i}t+\frac{1}{2}at^2$. Because the velocity at the first beam is greater than the velocity at the second beam, the acceleration is less than zero to indicate that it is in fact deceleration.

The acceleration is constant for a given surface and can thus be determined once for the first putt and stored as a constant until a different surface is used. Therefore, calibration for acceleration is essentially self-executing and there is no need to calculate it separately for each putt.

Either of the foregoing techniques for determining the deceleration can be employed, and the deceleration is then used in the calculation of the distance traveled by the bal between the beams so that its transverse position is determined from the beam geometry. It should be understood that the effect of deceleration can be determined and used in other ways, and that the present invention often functions with sufficient accuracy even when deceleration is ignored.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to. be understood that all matter herein set forth or shown in the accompanying drawings is to be interpreted as illustrative and not in a limiting sense.

Having thus described the invention, we claim:

1. Golf ball putting apparatus, comprising:

means for presenting a chamber having an open end into which a golf ball may be putted;

a paddle for ejecting the ball out of the chamber through said open end thereof to return the ball for another putting cycle;

means for mounting said paddle for substantially linear movement in said chamber between an extended position wherein the paddle is in proximity to said open end and a retracted position wherein the paddle is recessed behind said open end to allow the ball to enter the chamber, said mounting means being arranged to mount the paddle for pivotal movement about a generally horizontal pivot axis between a normal position wherein the paddle is oriented to sweep the ball toward the open end of said chamber and a tripped position wherein the paddle is pivoted from the normal position in a manner to eject the ball through the open end of the chamber;

power means for driving said paddle from the retracted position to the extended position; and means for effecting pivotal movement of the paddle from the normal position to the tripped position when the paddle reaches the extended position, thereby returning the ball for the next putt.

2. Apparatus as set forth in claim 1, wherein said mounting means comprises:

a carriage mounted in said chamber for reciprocating movement toward and away from said open end, said power means being operable to drive said carriage in said reciprocating movement; and means for mounting said paddle on said carriage for movement therewith toward and away from said open end and for pivotal movement relative to the carriage about said pivot axis between the normal and tripped positions.

3. Apparatus as set forth in claim 1, wherein said means for effecting pivotal movement of the paddle comprises a trip element situated to engage the paddle at a position thereon offset from said pivot axis to displace the paddle from the normal position to the tripped position when the paddle approaches said open end and is adjacent thereto.

* * * * *